US006227651B1

(12) United States Patent
Watts et al.

(10) Patent No.: US 6,227,651 B1
(45) Date of Patent: May 8, 2001

(54) LEAD FRAME-MOUNTED INK JET PRINT HEAD MODULE

(75) Inventors: Gary J. Watts, Corvallis; Ronald A Hellekson, Eugene, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/161,166

(22) Filed: Sep. 25, 1998

(51) Int. Cl.[7] ..... B41J 2/14
(52) U.S. Cl. ..... 347/50; 347/49
(58) Field of Search ..... 347/50, 19, 29, 347/49, 37; 439/66

(56) References Cited

U.S. PATENT DOCUMENTS

| | | | | |
|---|---|---|---|---|
| 4,590,482 | * | 5/1986 | Hay et al. | 347/19 |
| 4,635,073 | | 1/1987 | Hanson | 346/1.1 |
| 4,727,384 | * | 2/1988 | Tsuda | 347/50 |
| 4,806,106 | | 2/1989 | Mebane et al. | 439/77 |
| 4,944,850 | | 7/1990 | Dion | 204/15 |
| 5,005,070 | | 4/1991 | Altendorf et al. | 357/74 |
| 5,016,023 | * | 5/1991 | Chan et al. | 347/50 |
| 5,297,331 | | 3/1994 | Childers | 29/611 |
| 5,434,607 | | 7/1995 | Keefe | 347/50 |
| 5,648,804 | * | 7/1997 | Keefe et al. | 347/50 |
| 5,801,728 | * | 9/1998 | Yanagi et al. | 347/50 |

* cited by examiner

*Primary Examiner*—John Barlow
*Assistant Examiner*—Charles W. Stewart, Jr.

(57) ABSTRACT

An ink jet printer with a reciprocating carriage having a circuit element with a number of electrical contacts and a fluid aperture. A print head is connected to the circuit element and has a body defining an ink inlet aperture adjacent the fluid aperture. The print head includes a number of conductive leads at least partially encapsulated by a portion of the print head body and connected to an electrical contact on the circuit element. The print head includes a die electrically connected to the leads, and connected to the body in communication with the ink inlet aperture. The leads may be formed from a leadframe, and the die may be at least partially encapsulated by the body.

20 Claims, 7 Drawing Sheets

LEAD FRAME-MOUNTED INK JET PRINT HEAD MODULE

FIELD OF THE INVENTION

This invention relates to ink jet printing, and more particularly to print heads for such printers.

BACKGROUND AND SUMMARY OF THE INVENTION

In ink jet printers, ink jet print cartridges or pens are reciprocated on a carriage to print swaths on an advancing media sheet. Pens typically include an ink chamber partially filled with ink, with a print head having an array of nozzles for expelling ink droplets in a controlled pattern. The print head typically includes an integrated circuit chip or die that must be mechanically, electrically, and fluidicially connected to the other pen components.

In current pens, the die is connected to a flexible circuit that is connected to the pen body. The circuit has traces that are bonded at one end to the die, and extend an appreciable length to contacts that electrically connect to contacts on the printer carriage. This permits the pen to be removed and replaced as ink is depleted. The flex circuit also provides a mechanical mounting of the die to the pen body, including a seal to the body that prevents ink leakage. The flex circuit further defines a multitude of orifices that serve as the ink nozzles for printing.

While current systems are effective, it is desirable to reduce manufacturing and component costs by reducing the number of components, and by simplifying the various electrical, mechanical and hydraulic connections or functions. In particular, it is desirable to separate such functions so that modifications and advancements may be made to any one component without significant effect on the others.

The present invention overcomes the limitations of the prior art by providing an ink jet printer with a reciprocating carriage having a circuit element with a number of electrical contacts and a fluid aperture. A print head is connected to the circuit element and has a body defining an ink inlet aperture adjacent the fluid aperture. The print head includes a number of conductive leads at least partially encapsulated by a portion of the print head body and connected to an electrical contact on the circuit element. The print head includes a die electrically connected to the leads, and connected to the body in communication with the ink inlet aperture. The leads may be formed from a leadframe, and the die may be at least partially encapsulated by the body.

DETAILED DESCRIPTION OF A PREFERRED EMBODIMENT

Figure 1:
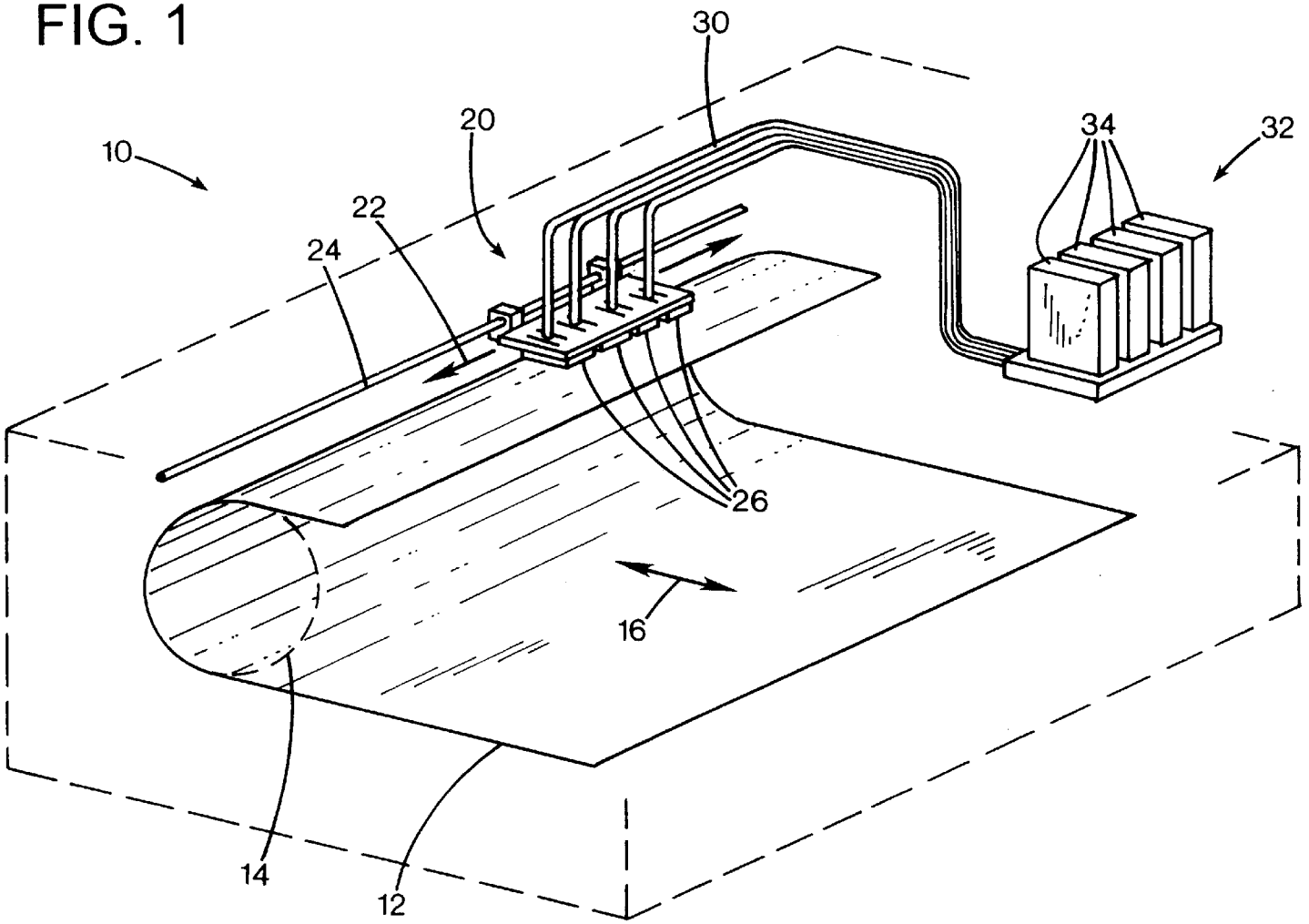
FIG. 1 is a simplified perspective view of an ink jet printer according to a preferred embodiment of the invention.

FIG. 1 shows an ink jet printer 10 into which a sheet of printer media 12 has been loaded. The printer has a media drive mechanism 14 that feeds the sheet along a paper path, with motion of the sheet defining a feed axis 16. A print head carriage 20 reciprocates along a scan axis 22 on a guide rod 24, and carries four print heads 26 that expel ink droplets onto the media surface to generate a desired printed image. In alternative embodiments of the invention, 1–6 or more different print heads or fluid sources may be employed. In the preferred embodiment, a flexible ink supply conduit 30 having a passage for each print head extends to a fixed ink supply 32 provided by four replaceable ink reservoirs 34. In an alternative embodiment, the replaceable reservoirs may be positioned on the carriage 20 to reciprocate with the print heads, each connected to a respective print head.

Figure 2:
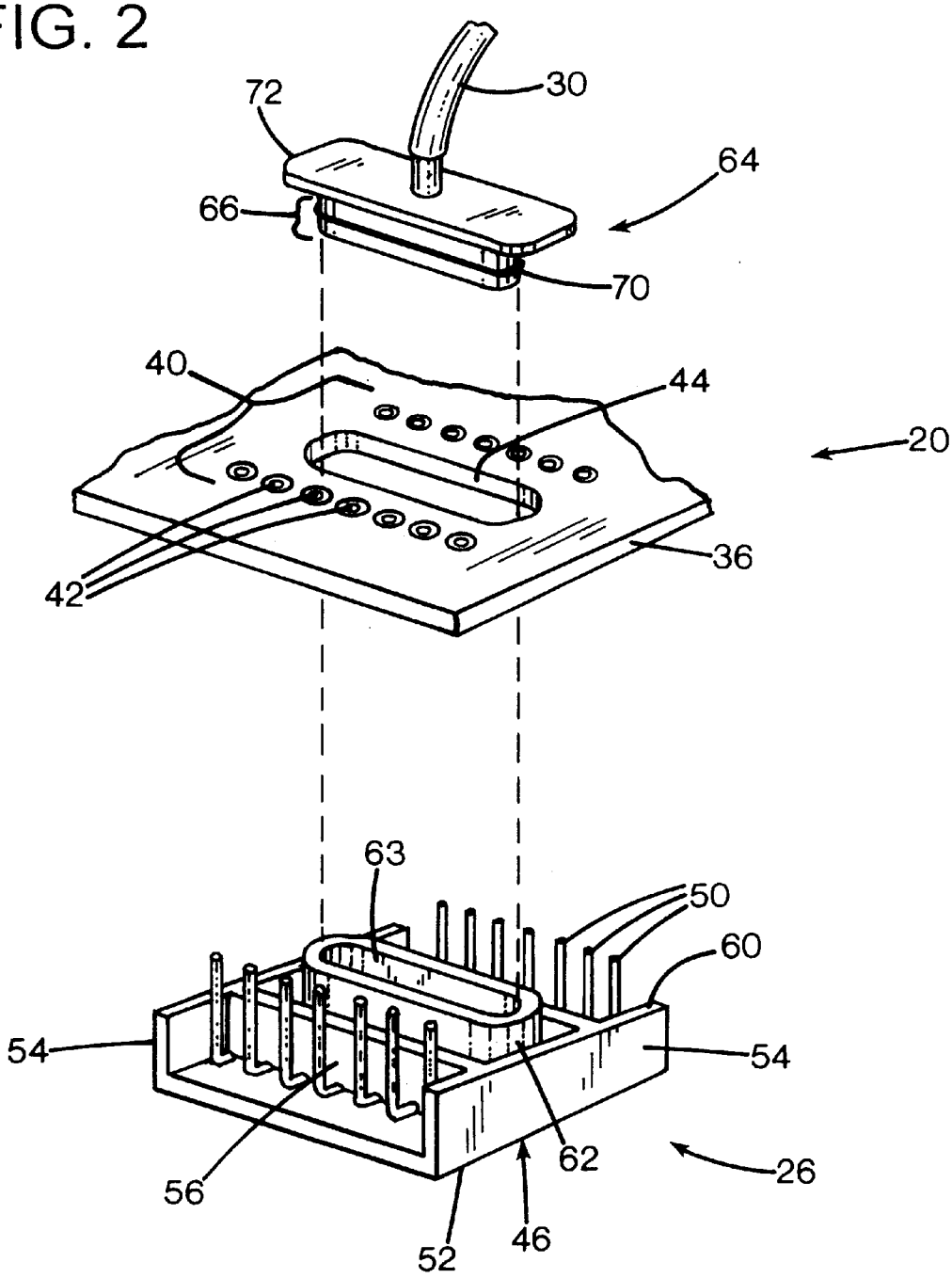
FIG. 2 is an enlarged exploded view of a print head assembly according to the embodiment of FIG. 1.

As shown in FIG. 2, the carriage includes a printed circuit board 36 that provides a frame for the carriage. For each print head, the board has a mounting location 40 that includes two spaced apart rows of evenly spaced plated through holes 42. A large fluid aperture 44 is positioned between the rows of through holes, occupying a major portion of the space between. The rows of through holes are oriented perpendicular to the scan axis of the carriage.

The print head 26 is a dual in-line package (DIP) having a plastic body 46 having a rectangular profile, with two rows of conductive leadframe pins 50 extending parallel to each other from the body in registration with the through holes of the carriage board 36. The body has a flat outlet surface 52 shown as the lower surface in FIG. 2, with vertical end walls 54 and side walls 56 extending away from the outlet surface to define a mounting surface 60 occupying a common plane at the free edges. The side walls are positioned medially of the pin rows, and are spaced apart from each other. An ink conduit 62 having an oblong cross section is positioned between the side walls and the end walls, and extends from the outlet surface beyond the mounting surface, as do the pins. The exterior of the ink conduit is sized to be received within the fluid aperture of the board when the print head is installed. The conduit defines an interior passage 63 extending nearly to the outlet surface.

Figure 3:
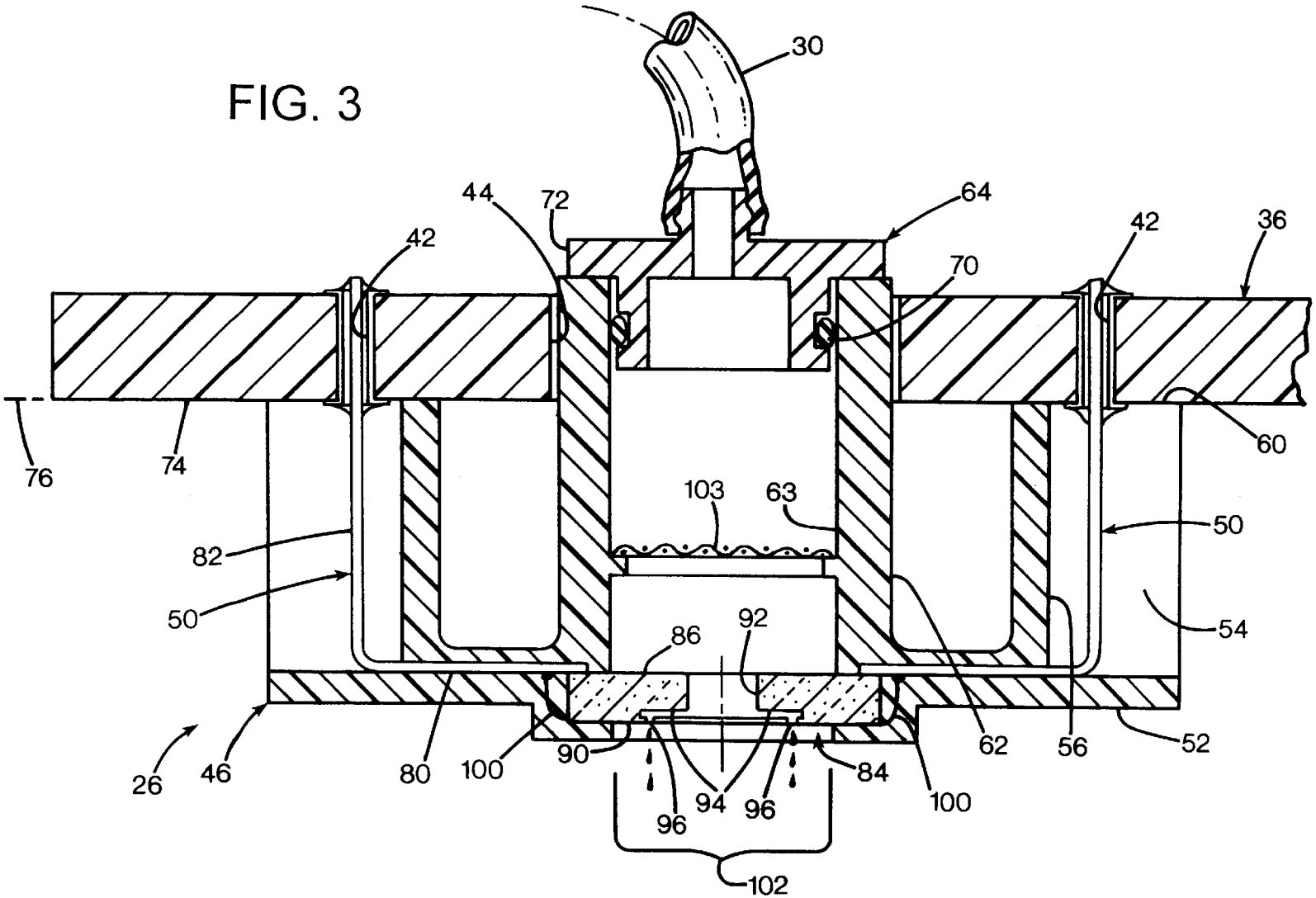
FIG. 3 is an enlarged sectional view of the print head of FIG. 2.

An ink supply connector 64 has an oblong plug portion 66 encircled by an O-ring gasket 70, and is sized to be closely received within the interior of the ink conduit 62, with the O-ring providing a fluid seal against the print head body. A flange portion 72 abuts the end of the print head ink conduit 62 to limit intrusion of the connector into the conduit As shown in FIG. 3, the print head 26 is mounted to the board 36, with the mounting surfaces 60 abutting a lower surface 74, which occupies a mounting plane 76. The bulk of the body, including the outlet surface, the side and end walls, and much of the conduit remain on a mounting side of the plane 76, below the board. Only a free end portion of each pin and an end portion of the conduit extends across the mounting plane, through respective holes in the board, and slightly beyond the opposite surface of the board. In an alternative embodiment, the leads may be bent or formed into a configuration suitable for surface mount soldering, instead of the through hole soldering illustrated.

The pins are planar metal elements cut from a common sheet in the manner of a conventional leadframe. The pins each have horizontal portions 80 that are largely encapsulated by the body, and which occupy a common plane; a vertical portion 82 of each pin extends perpendicular to that plane, with a free end occupying and soldered within a respective one of the plated through holes 42. The outlet surface panel 52 of the body extends laterally beyond any portion of the pins so that the pins are protected against mechanical damage during manufacturing and assembly, and so that the pins are shielded against atmospheric moisture than may be produced during printing.

An integrated circuit print head die 84 is partially encapsulated by the body 46. The die is positioned at the lower end of the ink passage 63, near the outlet surface, to enclose the passage and limit ink flow from the passage. The die has an inlet surface 86 facing the passage, and a nozzle surface 90 facing away from the board. The inlet surface defines an ink inlet slot 92 that extends partially through the thickness of the die along most of the length of the die. The inlet slot connects to lateral passages 94, of which each extends to one of a multitude of outlet nozzles 96. A resistor (not shown) within each passage near the outlet nozzle is connected to circuitry on the die, which energizes the resistors selectively to discharge ink droplets from the nozzles. The die circuitry includes a row of bonding pads along each lateral edge of the nozzle surface 90 of the die, each pad associated with a pin 50.

The die is positioned with its inlet surface 86 against the lower surfaces of the pin horizontal portions 80, with the die slightly overlapping a small portion of each pin. A wire stitch bond 100 electrically connects each bonding pad to a respective pin. The wire bonds are entirely encapsulated by the body, providing protection against mechanical damage or fluid contamination. The die is encapsulated about its entire perimeter to provide a fluid seal, while an exposed portion 102 of the outlet surface provides clearance for the nozzles 96, while the bond pads and wire bonds are covered. A major center portion of the inlet side of the die is unencapsulated, with the width of the passage 63 defining the extent of the exposed portion. The exposed portion is large enough to provide clearance for the entire ink inlet 92 on the die. A filter screen 103 occupies the passage 63 to prevent particle contaminants from entering the print head along with the ink.

Figure 4:
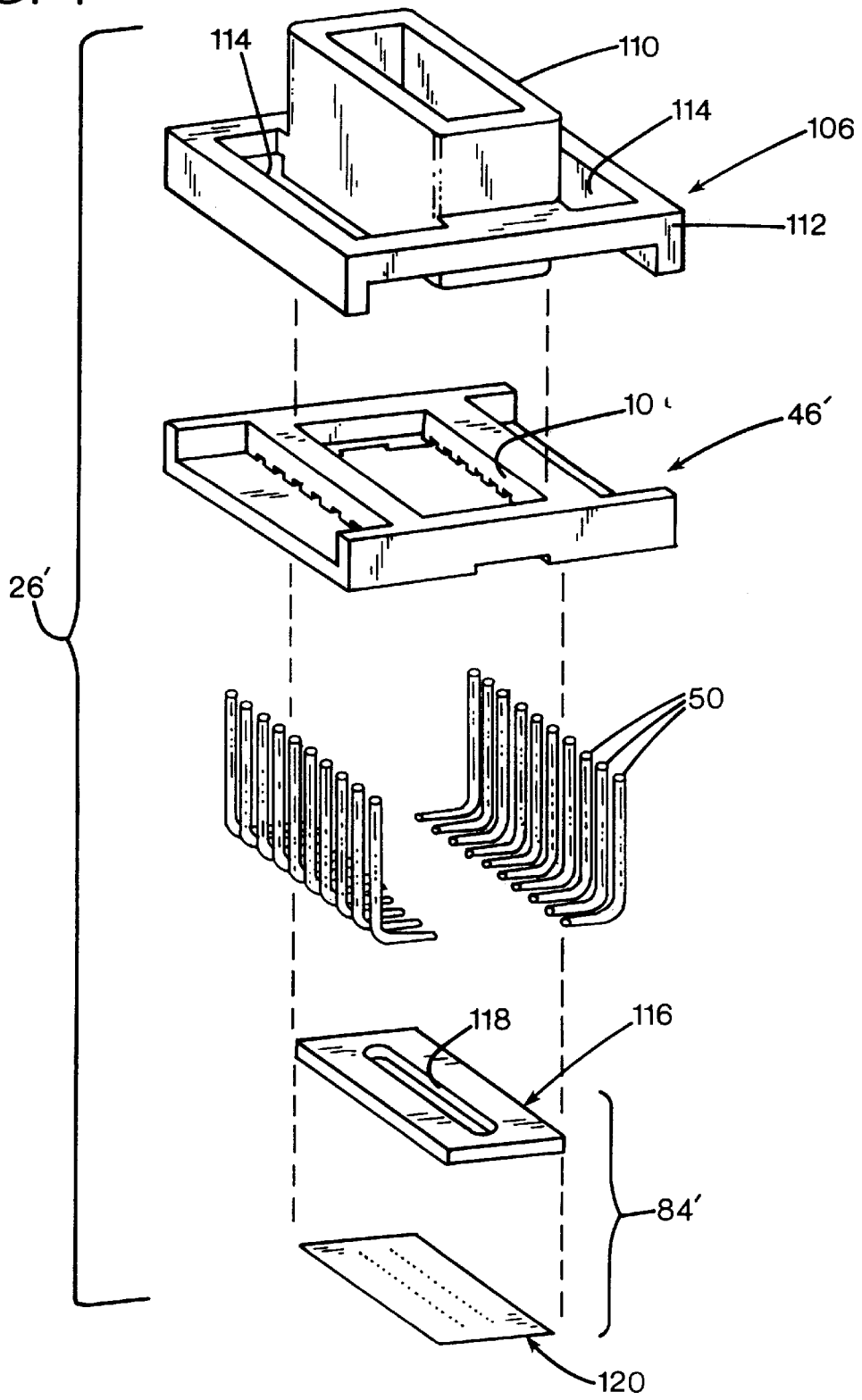
FIG. 4 is an enlarged exploded view of a print head assembly according to an alternative embodiment of the invention.

FIG. 4 shows an alternative print head 26' that is designed to be manufactured by encapsulating the leadframe prior to attachment of the die and wire bonds. The pins 50 are encapsulated in a body 46' that defines an oblong central aperture 104. A rigid plastic ink transmission element 106 has an oblong ink conduit 110 surrounded by a rectangular frame 112 having a profile the same as the perimeter of the body 46'. The outer profile of the conduit is sized to fit through the body aperture 104. On each major side of the conduit, a rectangular pin passage 114 allows the pins to pass through the ink transmission element. Element 106 and the body are glued or otherwise connected together about their peripheries to provide an enclosed package on all sides. A print head element 84' includes a die 116 defining an elongated inlet passage 118 extending fully through the thickness of the die, and an orifice plate 120 adhered to the die.

Figure 5:
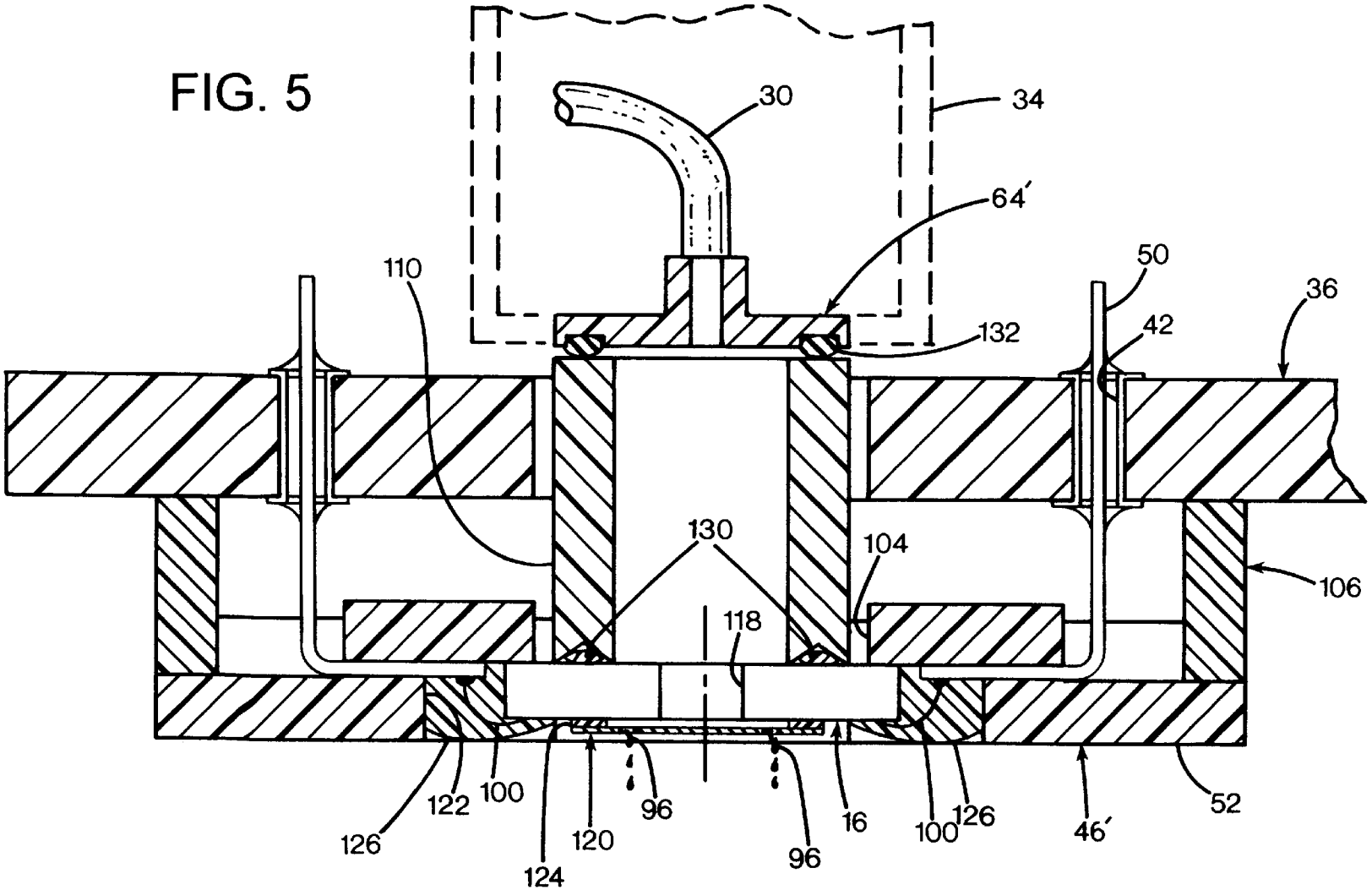
FIG. 5 is an enlarged sectional view of the print head of FIG. 4.

As shown in FIG. 5, the body defines a recessed die bonding pocket 122 in the outlet surface 52. The pocket is wider than the die to allow adequate clearance for bonding, and the die is wider than the aperture 104 to allow a ledge on each side on which the inlet side of the die rests. The body is molded about a portion of each pin to reveal a bonding end of each pin in the recess, with the bonding portions of the pins conformally resting on the same recessed surface as does the die. A wire bond 100 electrically connects each pin to a bond pad on the die. In the illustrated embodiment, the die is assembled with an orifice plate 120 that defines the nozzles through which ink is emitted. A barrier layer 124 provides a connection between the die and plate, and limits the ink to transmission from the inlet slot 118 to the nozzles 96.

To protect the wire bonds and to mechanically secure the die to the body, a bead 126 of secondary encapsulant such as an epoxy is deposited about the perimeter of the die. The bead overlaps the outlet surface of the die, but does not extend over the orifice plate, nor does it extend beyond the outlet surface 52 of the body. To provide a fluid seal, the lower end of conduit 110 is provided with a bead of adhesive 130, which adheres and seals to the inlet side of the die, clear of the inlet slot 118. Preferably, the ink transmission element and body are provided with a mechanical latch or snap mechanism (not shown) to prevent their separation after the conduit is adhered to the die.

Ink is supplied to the conduit by the ink tube 30, via an ink supply connector 64' provided with a face-contact O-ring 132 that does not require penetration of the conduit. A securement mechanism (not shown) maintains compression of the O-ring to prevent ink leakage. FIG. 5 also shows in dashed lines the further alternative of an on-carriage ink supply reservoir 134 that connects directly to the conduit, and which reciprocates along with the print head.

Figure 6:
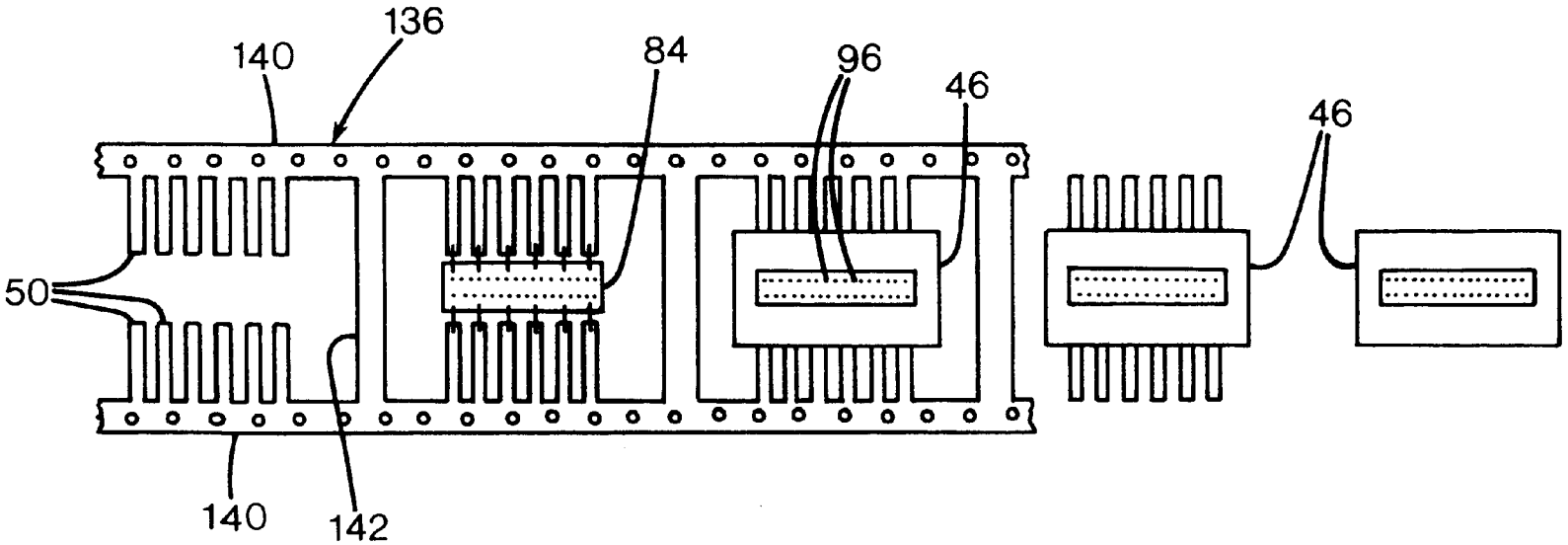
FIG. 6 is a plan view of the embodiment of FIG. 2 at various stages of manufacturing.
Figure 7:
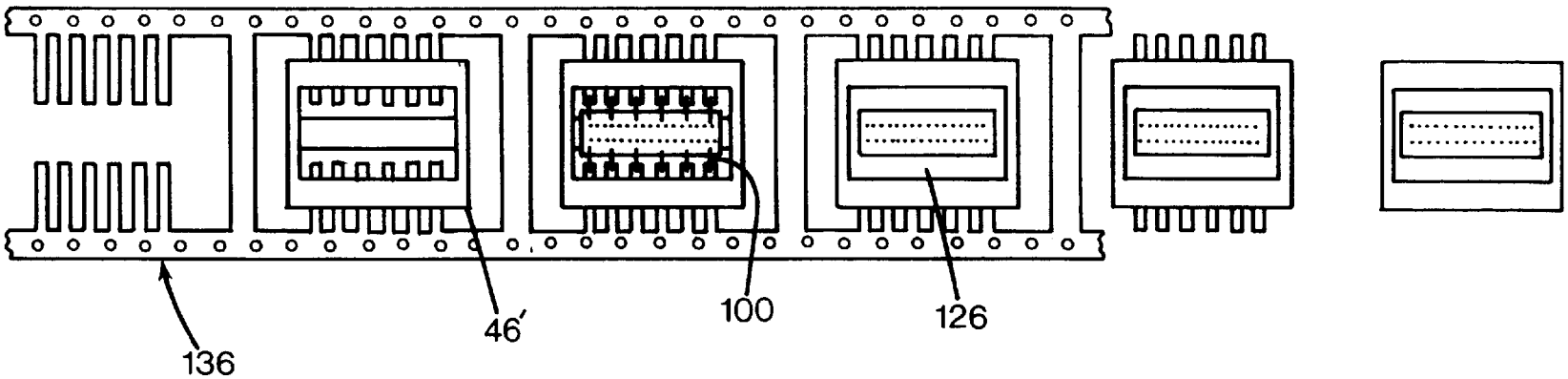
FIG. 7 is a plan view of the embodiment of FIG. 4 at various stages of manufacturing.

FIGS. 6 and 7 illustrate the steps of manufacturing the disclosed embodiments. The illustrations symbolically show adjacent components on a lead frame strip at different stages of manufacturing for clarity; in practice, the processes may occur in batches, and/or in separate machines. As shown in FIG. 6, a lead frame 136 is provided having perforated side strips 140 and reinforcing cross bars 152 separating the sets of leads 50. The leadframe is of construction typically used to package integrated circuits. At the second stage, the die has been bonded to the ends of the leads, and is ready for encapsulation. At the third stage, the die is encapsulated, with the encapsulant body 46 having a window to expose the nozzles 96 on one side, and the ink inlet 92 on the opposite side. At the fourth stage, the excess leadframe material is trimmed away, and at the fifth stage the leads are formed into the bent shapes illustrated earlier. Then, the print head may be tested prior to its installation in the circuit board. This has a significant advantage over existing print heads, which may not be tested until mounted to a pen body and filled with ink. Any failure of an existing print head die or orifice plate would require scrapping the entire pen, unlike the disclosed approach.

The FIG. 7 manufacturing process is similar to FIG. 6, except that the die is attached after initial encapsulation of the leadframe. The leadframe is shown at stage one, and is encapsulated by body 46' at stage two to secure the leads to each other, and to provide an attachment surface for the die. At any time after the leads are encapsulated, the individual print heads my be individuated from each other and the leads, as shown in stage three, which includes connecting the wire bonds 100. As shown, the die has been provided with the orifice plate attached. In stage four, the secondary encapsulant 126 seals and secures the die and bonds. After this, the leads are trimmed and bent. The adhesive bead is applied to the ink transmission element 106, which is secured to the body 46'. Testing and installation may now proceed as discussed above.

While the above is discussed in terms of preferred and alternative embodiments, the invention is not intended to be so limited. For instance, the various differing features of the preferred and alternative embodiments may be combined in different permutations to provide other useful embodiments.

In addition, the principles of the invention may be employed in combination with a flex-circuit-mounted film, and/or in combination with a conventional chip carrier having round pins. Also, the principles may be embodied in apparatus having any number of print heads. Further, instead of a reciprocating carriage, a stationary circuit board may support an array of print heads collectively forming a page wide printer, with the individual print heads being separately tested prior to assembly to provide high manufacturing yields.

What is claimed is:

1. An inkjet printer comprising:

a printer frame;

a carriage connected to the frame;

a circuit element connected to the carriage and including a plurality of electrical contacts and defining a fluid aperture;

a printhead connected to the circuit element and having a body having a contact portion contacting the circuit element, the printhead body defining an ink inlet aperture adjacent the fluid aperture;

the print head including a plurality of conductive leads, each having a first end, an intermediate portion encapsulated by a portion of the printhead body, and a free end connected to an electrical contact on the circuit element; and the print head including a printhead die electrically connected to the leads, and connected to the body in communication with the ink inlet aperture.

2. The printer of claim 1 wherein the circuit element is a printed circuit board.

3. The printer of claim 1 wherein the leads are soldered to the circuit element.

4. The printer of claim 1 wherein the leads comprise a leadframe.

5. The printer of claim 1 wherein the print head body encapsulates at least a portion of the die.

6. The printer of claim 1 wherein the print head body includes an ink conduit extending at least in part through the fluid aperture of the circuit element.

7. The printer of claim 1 wherein the body includes a contact portion contacting a major surface portion of the circuit element.

8. An ink jet print head comprising:

a body defining a mounting plane dividing a component side from a lead side, the body having a major portion positioned on the component side of the mounting plane, and the body having an ink conduit portion extending from the major portion across the mounting plane to at least in part occupy the lead side of the plane;

the ink conduit portion defining an ink passage;

a plurality of conductive leads each having a first end, an intermediate portion encapsulated by a portion of the body, and a free end extending away from the body at least to the mounting plane; and a die electrically connected to the first ends of the leads, and in communication with the ink passage.

9. The ink jet print head of claim 8 wherein the die is at least in part encapsulated by the body.

10. The ink jet print head of claim 8 wherein the leads comprise a leadframe.

11. The ink jet print head of claim 8 wherein the leads extend across the mounting plane, such that the print head may be connected to a printed circuit board having a major face in the mounting plane and plated through holes registered with the free ends of the leads.

12. The ink jet print head of claim 8 wherein the print head body encapsulates at least a peripheral portion of the die.

13. The ink jet print head of claim 8 wherein the print head body includes a contact surface portion occupying the mounting plane.

14. A method of manufacturing an ink jet printing apparatus comprising the steps:

providing a set of conductive leads;

encapsulating at least a portion of the leads in a common body, including defining an ink passage in the body;

electrically connecting a print head die to the leads, and in communication with the ink passage; and mounting the body onto a circuit element defining an circuit element aperture, including positioning the ink passage adjacent the aperture, electrically connecting the leads to the circuit element, and connecting the ink passage to a supply of ink via the circuit element aperture.

15. The method of claim 14 wherein mounting the body includes inserting the leads into a corresponding set of through holes provided in the circuit element.

16. The method of claim 14 wherein mounting the body includes passing a portion of the body defining the ink passage at least in part through the ink aperture.

17. The method of claim 14 including electrically connecting the die before encapsulating, and wherein encapsulating includes encapsulating at least a portion of the die.

18. The method of claim 14 wherein defining the ink passage includes maintaining an encapsulant away from a first surface of the die, and wherein encapsulating includes maintaining the encapsulant away from a second surface of the die opposite the first surface.

19. The method of claim 14 wherein defining the ink passage includes positioning an ink conduit within the circuit element aperture.

20. The method of claim 14 including testing the apparatus prior to mounting the body on the circuit apparatus.

* * * * *